US005411457A

United States Patent [19]

Hartdegen, III et al.

[11] Patent Number: 5,411,457

[45] Date of Patent: May 2, 1995

[54] INFANT EXERCISE AND ENTERTAINMENT DEVICE

[76] Inventors: George Hartdegen, III, Box 44, Bellevue, Id. 83313; George Hartdegen, Jr., deceased, late of Bellevue, Id., by George Hartdegen, III, personal representative

[21] Appl. No.: 116,987

[22] Filed: Sep. 7, 1993

Related U.S. Application Data

[63] Continuation of Ser. No. 968,295, Oct. 29, 1992, Pat. No. 5,242,338.

[51] Int. Cl.[6] ..... A63B 21/00

[52] U.S. Cl. ..... 482/96; 482/69; 482/93; 482/132

[58] Field of Search ..... 482/1–3, 482/72, 131, 80, 132, 96, 69, 93–95; 5/93.1, 93.2, 95, 904, 655, 662

[56] References Cited

U.S. PATENT DOCUMENTS

| | | | |
|---|---|---|---|
| 4,706,953 | 11/1987 | Graham | 482/132 X |
| 5,066,005 | 11/1991 | Lueke | 482/132 X |
| 5,211,607 | 5/1993 | Fermaglish et al. | 482/69 X |
| 5,263,913 | 11/1993 | Boren | 482/132 X |

*Primary Examiner*—Richard J. Apley
*Assistant Examiner*—Glenn E. Richman
*Attorney, Agent, or Firm*—Frank J. Dykas; Craig M. Korfanta

[57] ABSTRACT

An infant entertainment and development device (10) is disclosed which in its preferred embodiment includes a sliding inclined bed (11) which has a stationary perpendicularly disposed kick board (25) positioned at the lower foot end of the bed (11). The infant (1) is secured to the inclined carriage bed (11) using traps (19) attached to a cushion (18) which is in turn attached to the upper surface (12a) of the bed (11). The carriage bed (11) is slidably secured to a main frame (22) which includes an inclined base board (23). The carriage bed (11) is attached to the base board (23) using ball bearings (24). The inclined base board (23) is supported by a main frame incline support (29) which can be of adjustable height to adjust the angle of incline of the sliding carriage bed (11). A positive reinforcement sensory signal generator (30) is attached between the carriage bed (11) and the base board (23). The signal generator generates (30) a signal, generally a pleasing sound or interesting light display, in response to relative motion between the carriage bed (11) and the base board (23).

1 Claim, 7 Drawing Sheets

INFANT EXERCISE AND ENTERTAINMENT DEVICE

This application is a continuation of application Ser. No. 07/968,295, filed Oct. 29, 1992, U.S. Pat. No. 5,242,338.

BACKGROUND OF THE INVENTION

1. Technical Field

This invention generally relates to infant entertainment and development devices. More particularly, this invention relates to an infant entertainment and development device which promotes leg muscle and coordination development by exploiting a baby's natural inclination to kick his or her legs.

2. Background Art

A great many exercise and entertainment devices for infants have been invented and developed over the years, some of which have been highly successful. The device commonly known as a baby walker has probably been the most successful. However, some child development specialists have recently criticized the walker for causing adverse developmental effects. These specialists maintain that the walker forces the infant into the walking stage without progressing through the scooting and crawling stages, inhibiting natural muscle development and actually delaying learning to walk.

A second infant entertainment and exercise device is known as a jumper. One such device is sold under the trade name JOHNNY JUMP-UP and is manufactured by EVENFLO. These types of devices are characterized by an upright body harness suspended from several nylon straps which are in turn suspended from a spring which is suspended from the top of a doorway, normally using a spring-loaded clamp to secure themselves over the moldings at the top of the doorway. The length of the straps are adjusted so that the baby's feet just touch the floor when the spring is under tension. When the baby kicks, the spring tends to compress and thereby lift the baby off the floor. The bouncing motion continues as long as the baby kicks. These devices have been criticized as a safety hazard because violent jumps might result in the clamp becoming dislodged and the infant falling to the floor, with the spring and clamp falling on top of the infant.

It became apparent to the inventors that what was needed was an entertainment and exercise devise which was both safe and did not force the infant to bypass any of the normal developmental stages. Accordingly, the objects of the present invention include the provision of an infant entertainment and development device which promotes leg muscle and coordination development by capitalizing on a baby's natural inclination to kick his or her legs, without placing the baby at risk by elevating it above the floor an unsafe distance, without hanging potentially dangerous objects above the baby's head and which encourages development without bypassing normal developmental stages.

DISCLOSURE OF INVENTION

These objects and others are accomplished by the provision of a sliding inclined bed which has a stationary perpendicularly disposed kick board positioned at the lower foot end of the bed. The infant is secured to the inclined bed using a strap attached to a cushion which is in turn attached to the upper surface of the bed. The baby is positioned on the bed so that his or her feet rest against the kick board. When the baby kicks, the bed slides upward along the incline and returns to a resting position when the baby relaxes his or her legs.

The sliding inclined bed is slidably secured to a main frame which includes an inclined base board. The bed board is attached to the base board using ball bearings or a similar friction reducing assembly. The inclined base board is supported by a main frame incline support which can be of adjustable height to adjust the angle of incline of the sliding bed board. The kick board is attached to the lower foot end of the main frame assembly and is disposed in perpendicular relation to a coordinate plane defined by the base board.

A positive reinforcement sensory signal generator is attached between the bed board and the base board. The signal generator generates a sensory signal, for example, a pleasing sound or interesting light display, in response to relative motion between the bed board and the base board.

Traction appliques are strategically placed on the kick board to provide traction to help keep the baby's feet from sliding and to add aesthetic qualities to the apparatus.

BEST MODE FOR CARRYING OUT INVENTION

Figure 1:
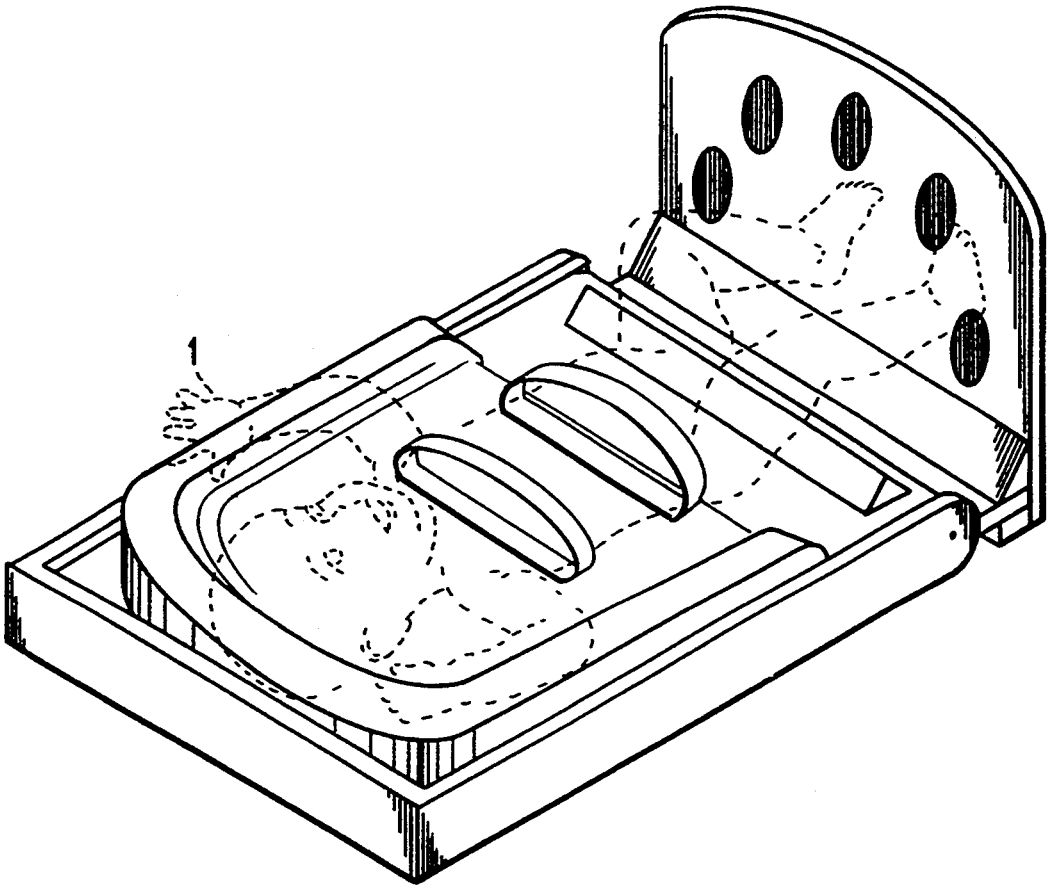
FIG. 1 is a three-quarter perspective view of the Infant Exercise and Entertainment Apparatus.
Figure 2:
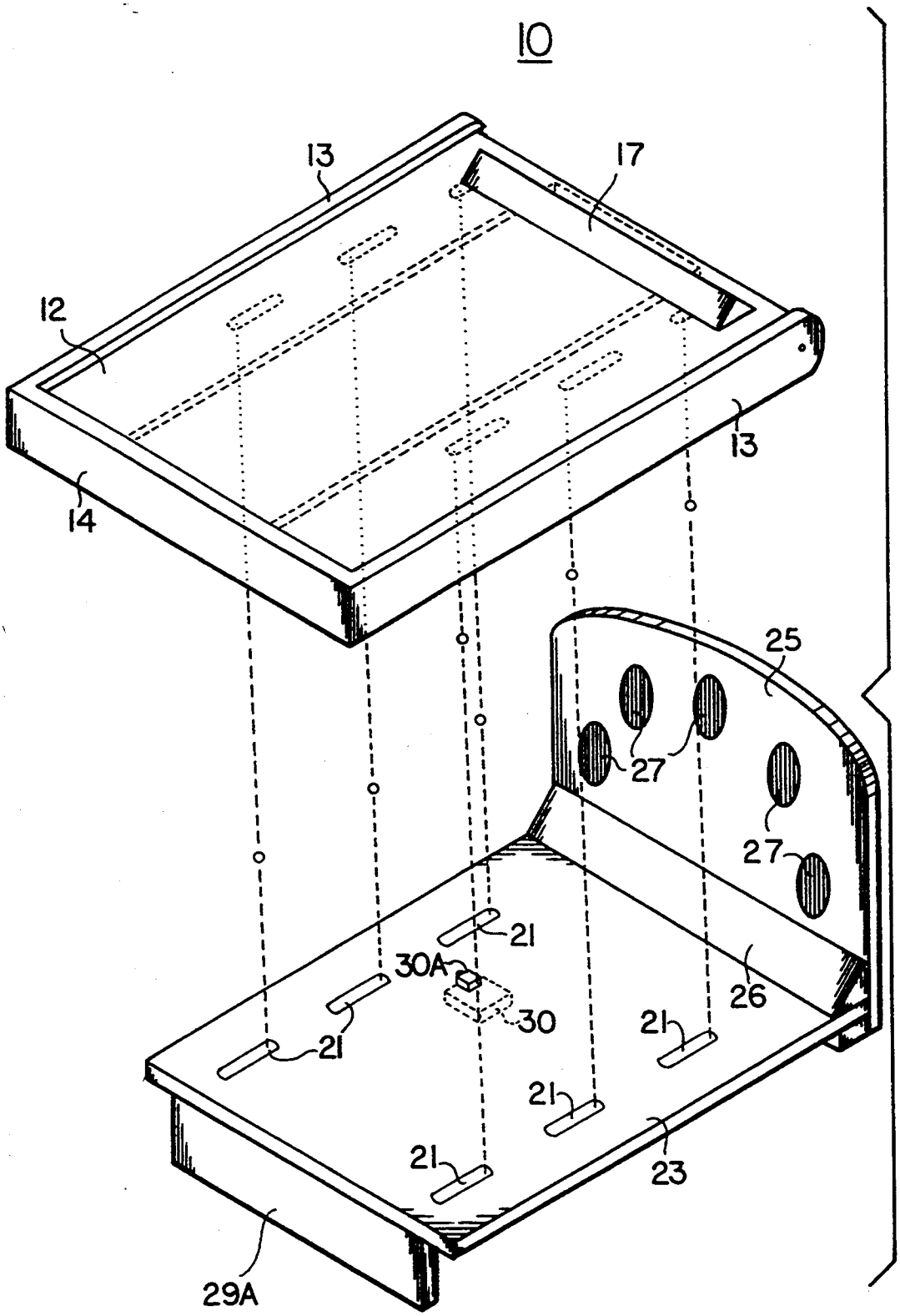
FIG. 2 is a partial exploded view of the Infant Exercise and Entertainment Apparatus.
Figure 3:
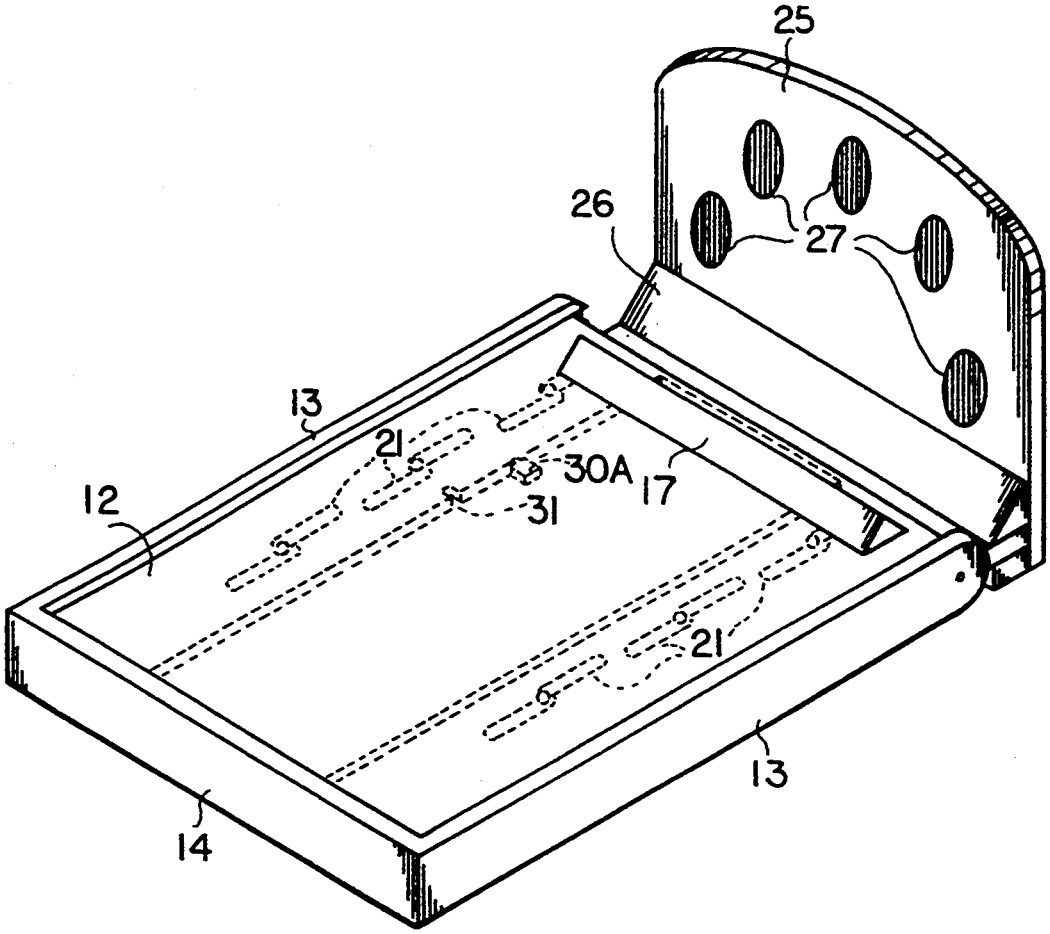
FIG. 3 is a partial three-quarter perspective view of the Infant Exercise and Entertainment Apparatus, showing the bearings and positive reinforcement device.

Referring now to the figures, an Infant Exercise and Entertainment Apparatus 10 is illustrated in detail and, as can be seen from the figures, it has as its primary components a carriage bed 11 and a carriage bed main frame 22. The main frame 22 includes an inclined frame member, here inclined base board 23, to which the carriage bed 11 is slidably secured. Carriage bed 11 is slidably secured to inclined base board 23 via a set of ball bearings 24, each of which rides in a pair of offset and opposing bearing races 21, with one bearing race 21 positioned on the underside of the carriage bed 11 and the offset cooperating race 21 positioned on the top side of inclined base board 23. Additionally, a kick board 25 is attached to the lower foot end of the main frame 22 and is disposed in perpendicular relation to the inclined base board 23.

Carriage bed 11 is constructed from a bed board 12 having a top surface **12*a* and a bottom surface 12*b*, a pair of side rails 13, a back rail 14 and a butt barrier 17**.

Figure 5:
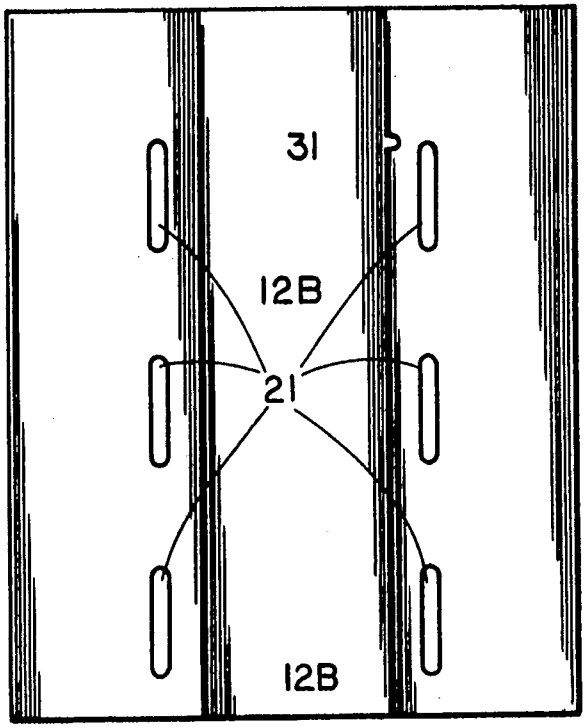
FIG. 5 a plan view of the bottom side of the bed board.
Figure 7:
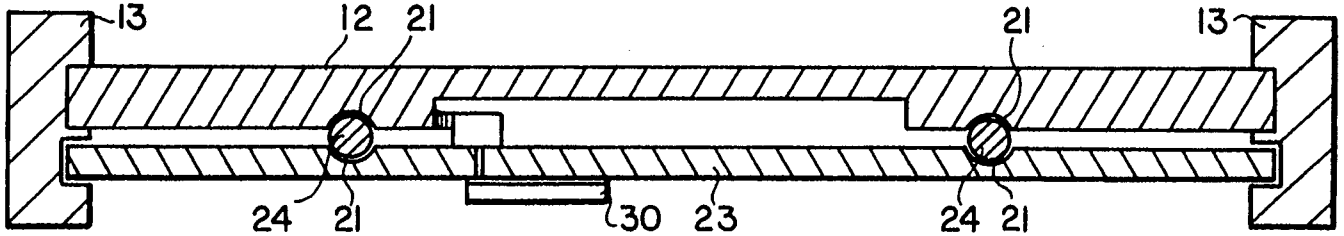
FIG. 7 is a partial section view of the Infant Exercise and Entertainment Apparatus taken along section line 7—7 in FIG. 3.
Figure 8:
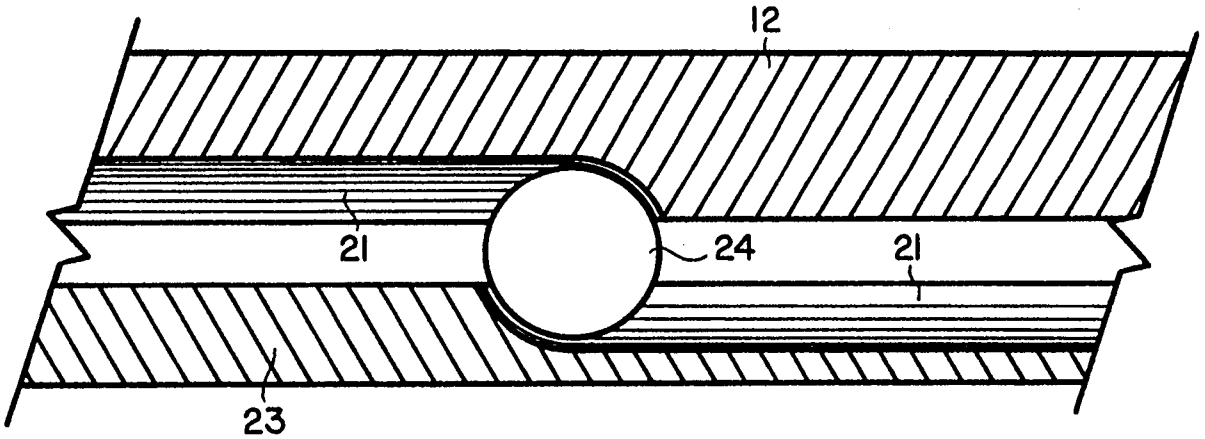
FIG. 8 is a partial section view of the Infant Exercise and Entertainment Apparatus taken along section line 8—8 in FIG. 3.

Bed board 12 is rectangular in shape having shorter head and foot ends and longer sides. A substantial width portion of each bottom surface marginal side edge is constructed of double thickness material, as is best shown if FIG. 7. Bearing races 21 are routed or otherwise formed in the bottom surface 12*b* of the double thickness marginal edges at the approximate locations shown in FIG. 5. These bearing races will be offset with respect to the bearings races 21 in the top surface of the base board 23, as is shown in FIG. 8. Additionally, indent 31 is formed in the bottom surface 12*b* of bed board 12 to cooperate with a roller type switch, explained later in this detailed disclosure.

Figure 4:
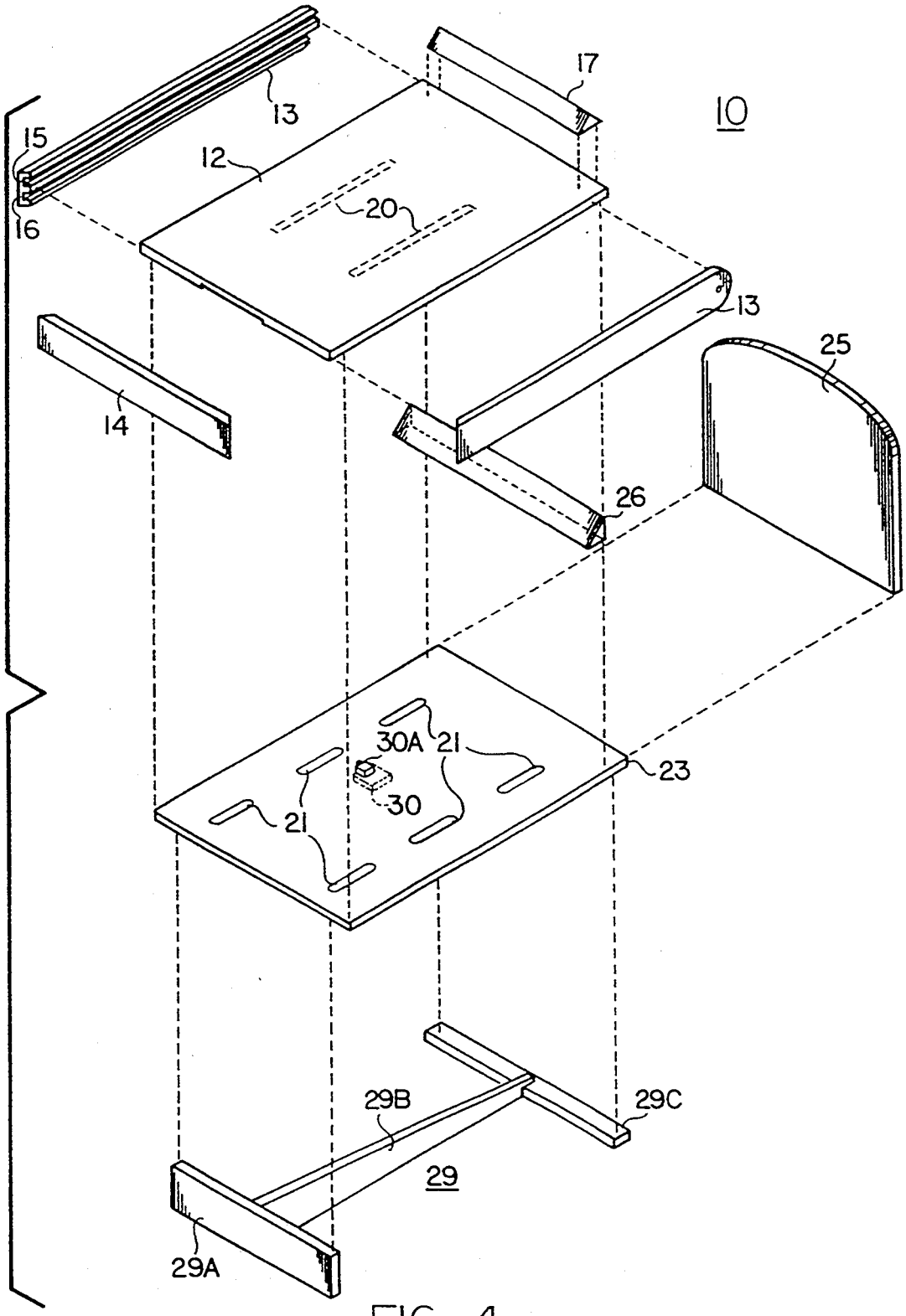
FIG. 4 is an exploded view of the Infant Exercise and Entertainment Apparatus without the padded baby support.
Figure 6:
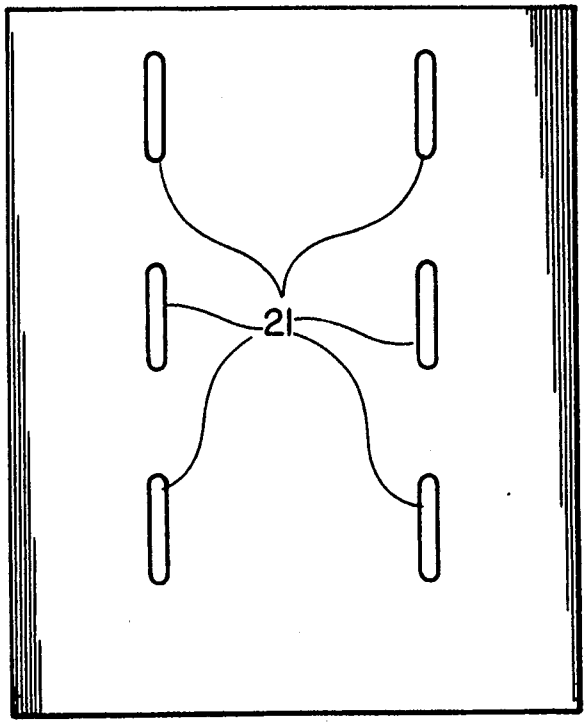
FIG. 6 a plan view the top side of the base board.

Side rails 13 are each attached to one of the two side edges of the bed board 12. As is indicated in FIGS. 4 and 7, each side rail has a pair of grooves, bed board groove 15 and base board groove 16, formed lengthwise along their inner surfaces. Bed board groove 15 is sized to frictionally engage the side edges of bed board 12 while the base board groove 16 is sized to slidably receive the side edges of base board 23. Back rail 14 is similarly configured and is attached to the head end of bed board 12. Butt barrier 17 is attached to the top surface 12*a* of bed board 12 at the bed board's foot end.

Padded baby support 18, also referred to as cushion 18, is removable attached to the top surface 12*a* of bed board 12 by a suitable attachment means such as hook and loop fasteners 20, more commonly known by its trade name VELCRO. The cushion itself is made of fabric with a polyester batting filler. However, it should be noted that other constructions such as foam rubber and the like might serve equally well. A pair of adjustable length safety belts 19 are attached to the padded baby support 18 for holding the baby 1 against the cushion and consequently to the carriage bed 11. Here the safety belts 19 are fashioned from nylon strapping to which cooperating portions of hook and loop fastener are attached. However, it should be apparent that other strap materials, belt buckles, clasps, etc. will also work for the purposes of the present invention.

Main carriage bed frame 22 is here formed of three primary components, the main frame member 23, also referred to as the base board 23, the kick board 25 and the main frame incline support 29. Base board 23 is held in an inclined disposition by affixing the base board 23 to the main frame incline support 29. Bearing races 21 are formed in the top surface of the base board 23 at positions which are offset from those formed in the bottom surface 12*b* of bed board 12. The bearing races 21 are offset such that the total length of travel of the carriage bed 11, with respect to main frame incline support 29, is equal to twice the length of the bearing races 21. This is best illustrated in FIG. 8.

Main frame incline support 29 here consists of a right triangular shaped length support 29*b* having a head end support 29*a* perpendicularly attached to the opposite side of the triangle and a foot end support 29*c* perpendicularly attached to the end of the length support 29*b* where its hypotenuse and adjacent sides meet. The main frame incline support 29 can also include an adjustable height feature which allows the angle of incline to be varied according to the level of development of any particular infant.

The kick board 25 is affixed to the foot end of the base board 23 and supported there by kick board brace 26. Here, kick board brace 26 is of standard corner brace configuration and is manufactured of wood. However, corner brackets, locking hinges or the like could also serve the purposes of the present invention. Additionally, variations in the materials and construction of kick board 25 and base board 23 might dictate different bracing structures or even allow the elimination of the corner brace altogether. Traction appliques 27 are applied to the kicking surface of kick board 25 to help prevent the baby's feet from sliding off the kick board 25. Appliques 27 are here similar to those used on the bottom of a bath tub, about a ⅛" thickness of rubber material.

Figure 9:
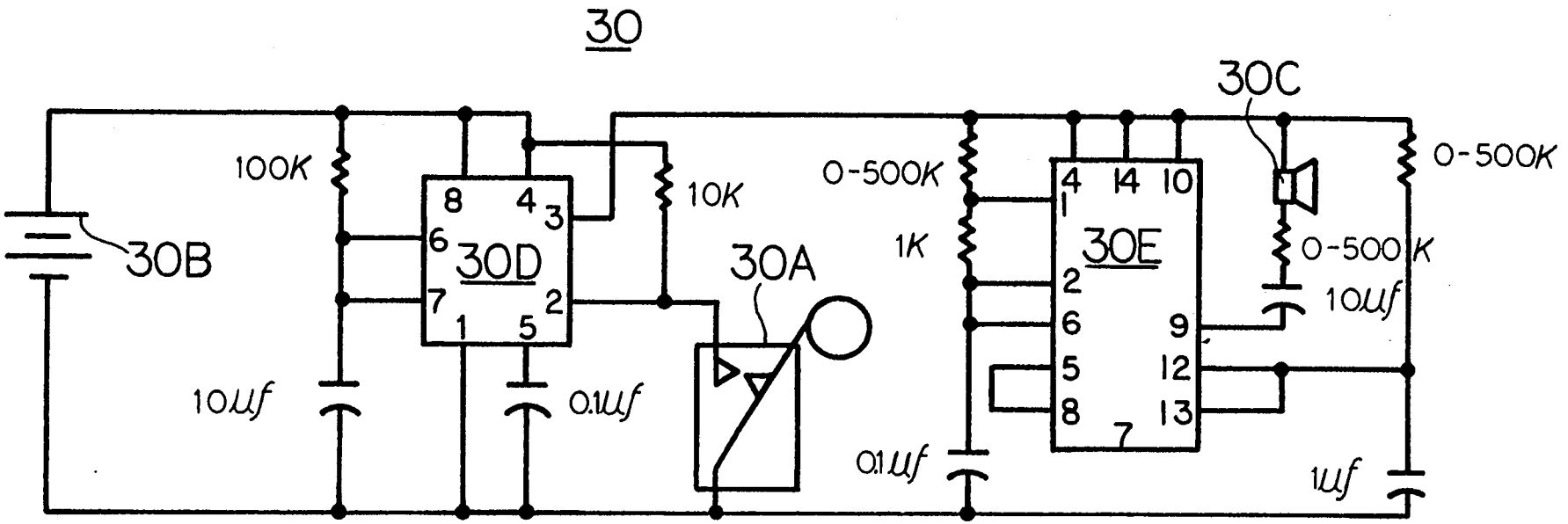
FIG. 9 is a representational circuit schematic for one possible positive reinforcement sensory signal generator.

A positive reinforcement signal generator 30 detects relative motion between the carriage bed 11 and the carriage bed frame 22. Here, the positive reinforcement signal generator 30 is an electronic circuit which emits an intriguing noise to encourage the infant to move the carriage bed 11. It should be noted that a visual signal such as a light display would also work, as would mechanical noisemakers, etc. One possible circuit for the positive signal generator 30 is shown in FIG. 9. The circuit employs a roller switch 30*a*, a battery 30*b*, a speaker 30*c*, a 555 timer IC 30*d* and a 556 timer IC 30*e*. In response to the closing of roller switch 30*a*, the 555 timer 30*d* will produce a pulse signal at pin 3 of up to a several second duration, which is here set to approximately 2 seconds. The duration of this pulse is dependent upon the RC series network attached to pins 6 and 7 of the 555 timer 30*d*. This pulse triggers the stepped-tone generator formed by the 556 timer 30*e*. The sounds produced can be varied by adjusting the values of the resistors bridging pins 1 & 4 and pins 7 & 12 and/or the values of the capacitors bridging pins 6 & 7 and 7 & 12.

The roller switch 30*a* is fixed on the base board 23 at a strategic location such that the roller switch 30*a* will be triggered by the roller switch indent 31 in the bottom surface 12*b* of bed board 12. The roller switch 30*a* is connected to the main portion of the positive reinforcement signal generator 30 via a pair of wires extending through a hole in the base board 23. The main portion of the positive reinforcement signal generator 30 is positioned either on the bottom of the base board 23 or on the main frame incline support 29 to provide easy access for changing the batteries 30*b*.

In this preferred embodiment, the majority of the infant exercise and entertainment apparatus 10 is constructed from standard wood products. The bed board 12, base board 23 and kick board 25 are all made from a dense fiber board, similar to hard board but smooth finished on both sides and having an enameled finish on one of its two sides. This product is commonly sold as a tub and shower surround material. The side rails 13, back rail 14, butt barrier 17 and main frame incline support 29 are all manufactured from wood, preferably a hardwood. It should be readily apparent that the aforementioned components could easily be manufactured from many diverse materials, using one of many manufacturing techniques. For instance, both the carriage bed assembly 11 and the main frame assembly 22 could each be molded in single unitary pieces from many different types of plastic. Other modifications and variations of this invention should be apparent to those skilled in the art.

In use the infant 1 is secured to the carriage bed 11 by placing him or her on the padded baby support 18 and fastening the safety belts 19 around the baby's chest and waist. The baby's natural reflex will normally result in the baby kicking or straightening out his or her legs. The resulting sensation and positive reinforcement signal will encourage the baby to continue this process.

While there is shown and described the present preferred embodiment of the invention, it is to be distinctly understood that this invention is not limited thereto but may be variously embodied to practice within the scope of the following claims.

We claim:

1. An exercise and entertainment apparatus for infants which comprises:

carriage bed frame means including an inclined frame member, a kick board being perpendicularly disposed with respect to the inclined frame member and a support member for holding the inclined frame member in an inclined position;

a carriage bed being configured to receive an infant in a relatively horizontal position lying on its back;

bearing means slidably attaching the carriage bed to the carriage bed frame means;

the carriage bed includes a bed board having a top surface and a bottom surface where the bottom surface has a plurality of bearing races formed therein;

the inclined frame member comprises a base board having a plurality of bearing races formed in a top surface and disposed in linear offset alignment with respect to the bearing races formed in the bottom surface of the bed board; and a plurality of ball bearings, one each of which is positioned between a bearing race in the bed board and a bearing race in the base board, the bearings; whereby the infant may extend the carriage bed away from the kickboard by an extension of his legs, the carriage bed returning to a position close to the kickboard via the incline of the incline frame member to a position close to the kickboard means being defined by the combination of the bearing races and the ball bearings.

* * * * *